US005381723A

United States Patent [19]

Nilsson et al.

[11] Patent Number: 5,381,723

[45] Date of Patent: Jan. 17, 1995

[54] HYDRAULIC MOTOR

[75] Inventors: Dan Nilsson, Sjuntorp; Ove Donnerdal, Partille, both of Sweden

[73] Assignee: Aktiebolaget Electrolux, Stockholm, Sweden

[21] Appl. No.: 102,377

[22] Filed: Aug. 5, 1993

[30] Foreign Application Priority Data

Aug. 21, 1992 [SE] Sweden ..... 92023993

[51] Int. Cl.[6] ..... F15B 11/08

[52] U.S. Cl. ..... 91/437; 418/206; 91/461

[58] Field of Search ..... 418/206; 91/437, 438, 91/439, 461

[56] References Cited

U.S. PATENT DOCUMENTS

| | | | |
|---|---|---|---|
| 3,175,468 | 3/1965 | Miller | 418/206 |
| 3,614,275 | 10/1971 | Eibsen | 418/206 |
| 4,571,941 | 2/1986 | Aoyagi et al. | 91/461 X |
| 4,645,439 | 2/1987 | Way | 418/206 X |
| 4,676,141 | 6/1987 | Park | 91/461 X |
| 4,955,283 | 9/1990 | Hidaka et al. | 91/461 X |

FOREIGN PATENT DOCUMENTS

| | | | |
|---|---|---|---|
| 548714 | 12/1956 | Belgium | 418/206 |

*Primary Examiner*—Edward K. Look
*Assistant Examiner*—Hoang Nguyen
*Attorney, Agent, or Firm*—Frost & Jacobs

[57] ABSTRACT

The invention relates to a hydraulic motor having a motor body comprising a first and a second part (71, 72) which are joined to each other in a parting plane (74). A motor chamber (2) with driving cogwheels (10, 11) is formed by borings (84, 85), which extend from the parting plane into a certain depth in at least one of the first and second parts (71, 72). A by-pass conduit (15) is provided between the inlet and outlet hydraulic conduits of the motor chamber. In the by-pass conduit there is provided a main valve (20) for closing and opening the by-pass conduit for starting and for stopping the hydraulic motor, respectively. The by-pass conduit is formed by portions (16, 17) of a first (100) and a second (101) connection between the parting plane (74) and the inlet conduit (5), and between the parting plane (74) and the outlet conduit (7), respectively, and by a cross link (18) between the first and second connections (100, 101).

17 Claims, 5 Drawing Sheets

HYDRAULIC MOTOR

TECHNICAL FIELD

The present invention relates to a new hydraulic motor. Particularly, the invention relates to a hydraulic motor intended and suited to be used in portable machines, for example in order to power rotating cutting discs, circular saw discs and the like.

BACKGROUND OF THE INVENTION

Many portable machines are driven hydraulically by hydraulic motors. Examples of machines which often are hydraulically driven are cutting machines with rotary cutting discs, circular saws, some types of boring machines, etc. A number of requirements are raised on those hydraulic motors which are used in this types of machines. They must not be too heavy and clumsy but instead be light and have a shape which is adapted to and which does not require a big space in or on that machine where they shall work. They shall be easy to operate, which i.a. implies that only quite a small power shall be needed for start and stop. They shall be comparatively cheap to manufacture, wherein it shall be observed that the machining of the motor body is responsible for a major part of the total costs. In order that the manufacture shall be as cheap as possible, the motor body therefore shall consist of only a few parts, at the same time as the design should be such that the number of rearrangements of the work-pieces for the machining operations shall be as small as possible. It is also desirable that there are as few places as possible in the motor body which have to be sealed in order to reduce the risks of leakage.

The above mentioned desired features have not been satisfied by today's technique.

BRIEF DESCRIPTION OF THE INVENTION

The purpose of the invention is to provide an hydraulic motor which better than those hydrulic motors which are known today satisfies the above mentioned requirements and wishes. The invention is characterized in that the motor body comprises a first and a second part, which parts are joined to each other in a parting plane, that a motor chamber is defined by borings which extend from the parting plane into a certain depth in at least one of said first and second parts, that driving means are provided in the motor chamber in order to rotate an axle under the pressure from the hydraulic medium, said axle extending through an axle passage through one of said first and second parts, that an inlet hydraulic conduit extends to the inlet side of the motor chamber, that an outlet conduit extends from the outlet side of the motor chamber, that a by-pass conduit is provided between the inlet and outlet conduits, and that a main valve is provided in the by-pass conduit in order to close and to open the by-pass conduit for stopping and for starting the hydraulic motor, respectively.

As is mentioned in the preamble, the hydraulic motor shall be cheap to manufacture, wherein it shall be particularly observed that the machining of the motor body is responsible for the major cost. The invention provides a possibility to manufacture the motor body from only a few main parts, which makes it possible to the make the manufacture cheaper at the same time as the number of sealing places in the motor body is reduced, which reduces the risks of leakage. More particularly, the motor body according to a preferred embodiment consists of only two main parts, namely said first and second parts, wherein one of these ones, the second part, at the same time is a motor body cover. As an alternative, the second of these main Darts in its turn may consist of two parts, namely an intermediate part and a cover. It is true that this requires another parting plane, which has to be sealed, but at the same time this alternative offers advantages from a manufacturing point of view. In case of this alternative embodiment, the second parting plane is located such that it will coincide with the upper wall of the motor chamber, in parallel with the first parting plane bordering the first part.

Further, in order to make the manufacture cheaper, the design should be such that the number of rearrangements of the work-pieces in connection with the machining is as small as possible. According to one aspect of the invention, these aims can be satisfied therein that the machining of the parts of the motor body to a high extent is carried out towards those surfaces which are facing each other in the parting plane, or in the parting planes, respectively. In other words the motor "is machined from inside". Thus, according to an aspect of the invention, the by-pass conduit may be defined by portions of a first and of a second connection between the (first) parting plane and the inlet conduit, and between the parting plane and the outlet conduit, respectively, and by a connection between said first and second connections, wherein the main valve may be provided in one of said first and second connections.

According to another aspect of the invention the main valve is provided to be actuated by a pi lot valve provided in the motor body. More particularly, the pilot valve may be provided in the region of one of said first and second parts or in regions of both of said parts in connection to the parting plane between them, wherein means for operating the pilot valve may be provided i n a boring extending through one of said main parts all the way to at least the parting plane, and wherein conduits to and from the pilot valve may be provided between the by-pass conduit on the back of the main valve and the pilot valve, and between the pilot valve and the outlet hydraulic conduit, respectively.

Further characteristic features, aspects and advantages of the invention will be apparant from the appending claims and from the following description of a preferred embodiment.

BRIEF DESCRIPTION OF DRAWINGS

In the following description of a preferred embodiment reference will be made to the accompanying drawings, in which FIG. 1 schematically illustrates the mode of working of the hydraulic motor during operating;

FIG. 10 therefore has been shown by dashed lines.

The same reference numerals have been used in FIG. 3–10 for details which have direct correspondences in FIG. 1 and 2.

DESCRIPTION OF A PREFERRED EMBODIMENT

Figure 1:
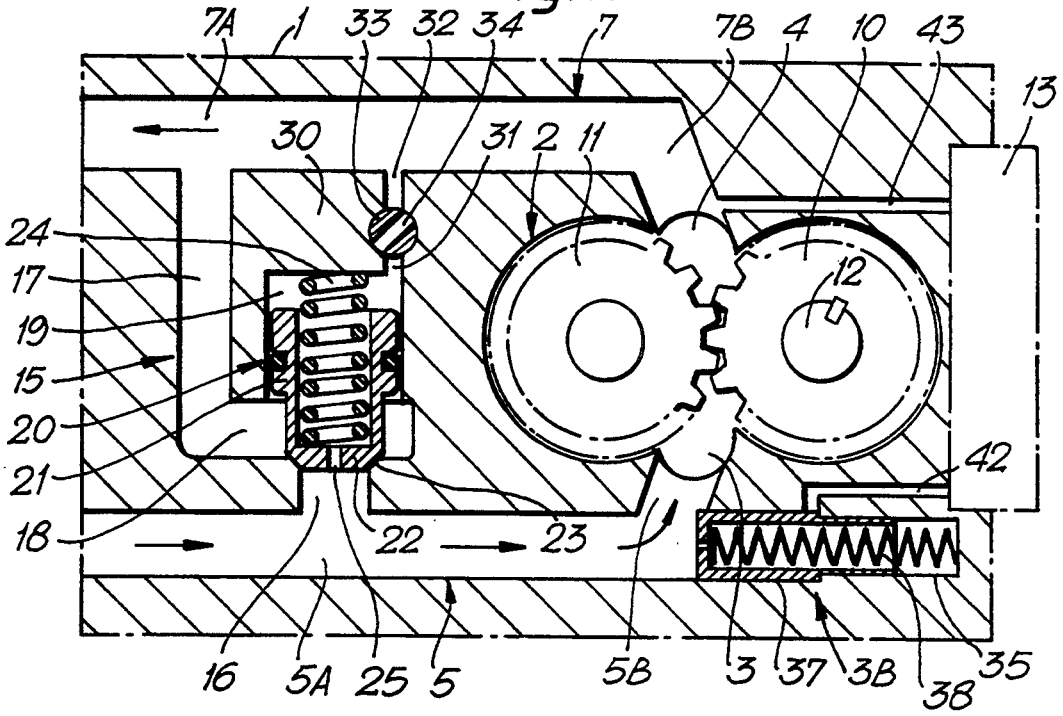
Figure 2:
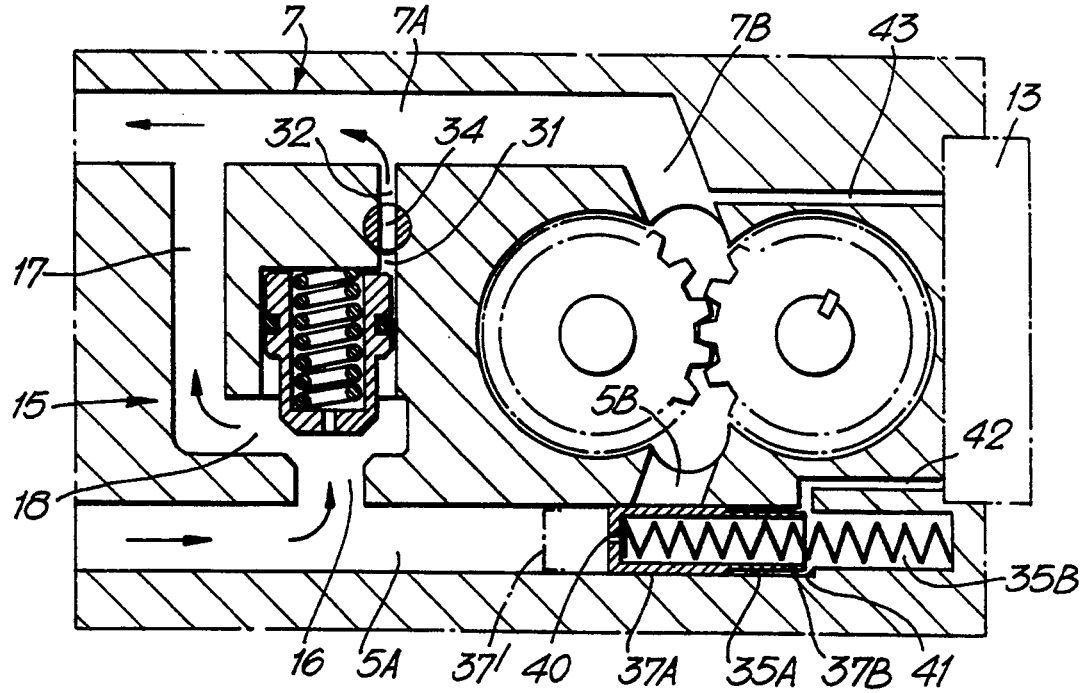
FIG. 2 schematically illustrates the mode of working during standstill.

In FIG. 1 and FIG. 2 a symbolically shown motor body is designated 1. In the motor body there is a motor chamber generally designated 2. An inlet chamber and an outlet chamber in direct connection to the motor chamber 2 are designated 3 and 4, respectively. An inlet conduit to the inlet chamber 3, generally designated 5, consists of a first section 5A and a second section 5B at an angle to the first section. Corresponding sections of an outlet conduit 7 from the outlet chamber 4 are designated 7A and 7B, respectively.

In the motor chamber 2 there are a pair of cog wheels 10, 11, which in a manner known per se are driven by the hydraulic oil which may enter the inlet chamber 3 via the inlet conduit 5. One of the cog wheels, cog wheel 10, has an output shaft or axle 12. A bearing housing for the axle 12 is symbolically designated 13.

Between the inlet conduit 5 and the outlet conduit 7, more particularly between the sections 5A and 7A in said conduits, there are, according to the chosen application of the invention, a by-pass conduit which is generally designated 15. This conduit consists of a first by-pass portion 16 in communication with the first section 5A of inlet conduit 5 and a second by-pass portion 17 in communication with the first section 7A of outlet conduit 7, and between said first and second by-pass portions a cross link 18.

In the axial elongation of the first by-pass portion 16 there is a cylindrical valve chamber 19 accomodating a main valve generally designated 20. The main part of the main valve consists of a valve body, the rear part of which is designed as a piston 21, which has a larger cross area than the front part of the valve body, which is designed to define a plug 22. The valve body can be displaced in the valve chamber 19. The plug 22 in the sealing position of valve 20 contacts a valve seat 23 in said first by-pass portion 16. A return spring is designated 24. A small through-boring 25 is provided in the plug 22.

A pilot valve 30 (an operator valve which can be operated by an operator by means of not shown operating means) is provided in a conduit between valve chamber 19 and outlet conduit 7, more particularly between a connection 31 extending from valve chamber 19 and a connection 32 to outlet conduit 7. The pilot valve 30 can for example be of turning slide type. The turning slide is designated 33 and a passage through the turning slide 33 is designated 34. The passage 34 and the connections 31 and 32 have a larger cross section than the opening 25 in the valve plug 22.

In the axial projection of the first section 5A of inlet conduit 5 there is provided a differential pressure type plunge valve 36 in a plunge chamber consisting of a boring in the motor body. In the plunge chamber 35 there is provided a plunge consisting of a sleeve. The plunge can be displaced inwardly in plunge chamber 35 to the position shown in FIG. 1 under the influence of the hydraulic pressure in inlet conduit 5 compressing a return spring 38.

The plunge chamber 35 consists of two sections, namely a first front section 35A adjacent to the second section 5B of inlet conduit 5, said first plunge chamber section 35A having a diameter and a cross section area equal to that of the first section 5A of the inlet conduit, and a second rear section 35B having a smaller diameter and a smaller cross section area.

Also the sleeve shaped plunge 37 has two sections having different diameters and cross section areas. A first front plunge section 37A has the same diameter and cross section area and also the same length as the first plunge chamber section 35A. A second rear plunge section 37B has the same diameter and cross section area as the rear plunge chamber section 35B but is preferably somewhat shorter than that one. At least it is not longer. The boring/plunge chamber 35 constitutes the cylinder of plunge 37. In this cylinder there is provided an annular edge 41 in the bottom of the first front plunge chamber section 37A. A first drainage conduit 42 leads from an opening adjacent to said edge 41 to the bearing housing 13, and from the bearing housing 13 a second drainage conduit 43 leads to the outlet conduit 7. In the front end of the plunge 37 there is also a passage in the form of a small hole 40.

How the principles shown in FIGS. 1 and 2 can be used in practice will be explained by the following description of a preferred embodiment of the hydraulic motor according to FIGS. 5–10. First, however, it will be briefly explained what is shown in FIGS. 3 and 4.

Figure 3:
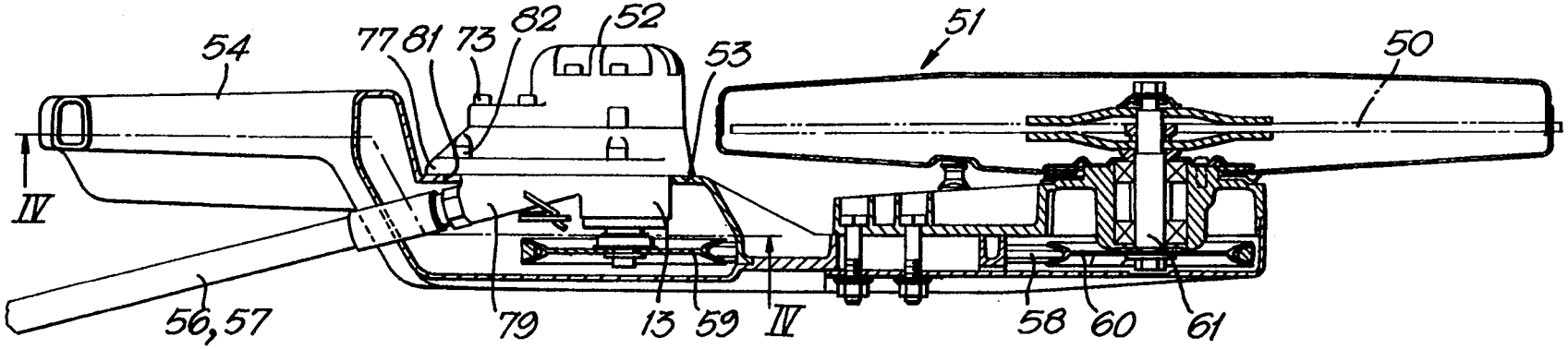
FIG. 3 is a side view of a cutting machine with a hydrulic motor according to the invention.
Figure 4:
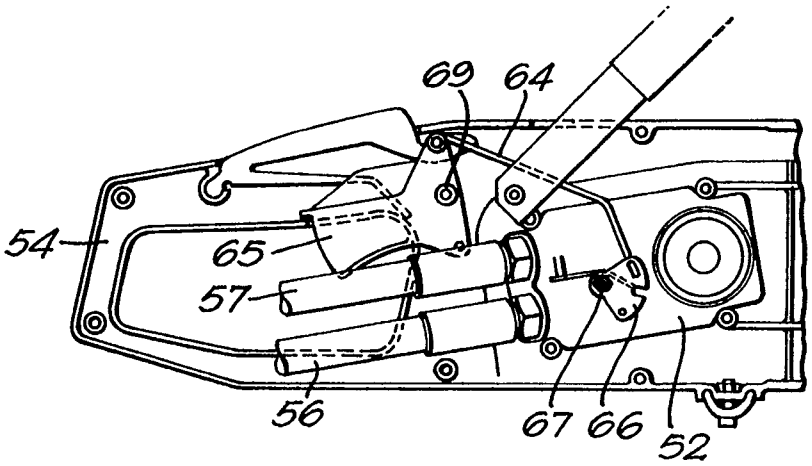
FIG. 4 shows a section through this machine along the line IV—IV in FIG. 3.

FIGS. 3 and 4 illustrate an example of the environment in which the hydraulic motor shall work, in this case as a driving motor for the rotating cutter disc 50 on a cutter machine 51. The hydraulic motor, generally designated 52, is mounted in the framing 53 of the machine, more particularly in the space between a handle portion 54 and a housing 55 for the cutter disc 50. It should be recognized that this space is very limited. The motor 52 therefore must not be clumsy but have a size and shape which is well adapted to the machine. This condition also concerns the hydraulic conduits 56, 57, which shall be possible to connect to the hydraulic motor 52 in such a way that they will not interfere with handle 54 and at the same time be substantially aligned with the working direction of the machine.

Among other details in FIG. 3 there should be mentioned the transmission belt 58 between a belt pulley 59 on the output shaft 12 of the hydraulic motor and a belt pulley 60 on the driving shaft 61 of the cutter disc 50.

In FIG. 4 the link 64 should be notified extending between a trigger 65, which has a design known per se, and a moment lever 66, which has the shape of a plate mounted on an outer pin 67 on the turning slide 33 of pilot valve 30 for the operation of the hydrulic motor 52.

Figure 5:
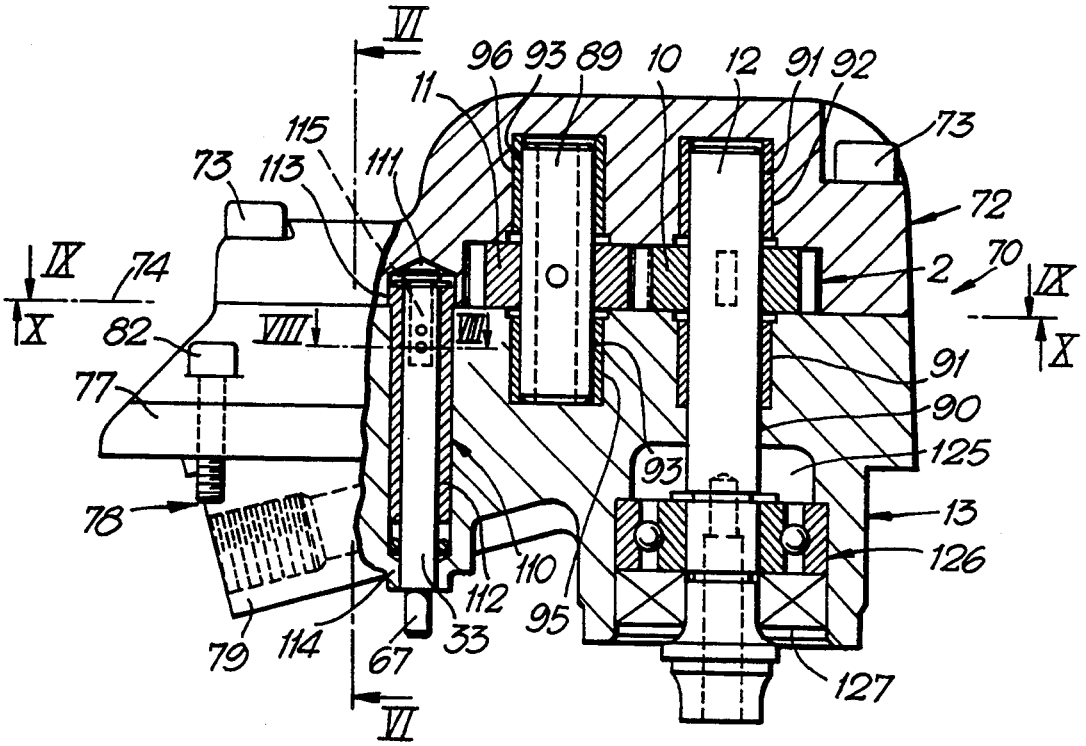
FIG. 5 is a side elevation and a longitudinal section through the hydraulic motor according to the preferred embodiment.

In FIG. 5 the motor body of the hydraulic motor 52 is designated 70. The motor body has two main parts; a first main part or base part 71, and a second main part or cover 72. The cover 72 is secured to the base part 71 by means of screws 73 in a parting plane 74. The two flat surfaces of the base part 71 and of the cover 72, which sealingly are pressed towards each other in the parting plane 74, have been designated 75 and 76, respectively, in FIGS. 9 and 10. Both these surfaces 75 and 76 thus are completely flat, which means that they have no projecting portions.

The base part 71 consists of a flange portion 77 and beneath the flange portion a bottom portion generally designated 78. This bottom portion 78 consists of a connection portion 79 for the hydraulic conduits 56, 57, FIG. 3, and a bearing housing 80. The bottom portion 78 is recessed in an opening 81 in the framing 53. The base part 71 and hence the entire hydraulic motor 52 is secured in the opening 81 and screwed to the framing 53 by means of screws 82 extending through borings in the flange portion 77.

The previously mentioned motor chamber 2 is formed of two borings 84, 85 in the cover 72. Also the inlet chamber 3 and the outlet chamber 4 consist of borings in the cover 72. Said bored recesses 3, 4, 84 and 85 are made normal (perpendicular) to the flat surface 76 of the cover 72 to a certain depth from surface 76.

In the motor chamber 2/the borings 84, 85 the previously mentioned first and second cog wheels 10, 11 are provided. These cog wheels cooperate in a manner known per se and typical for hydraulic motors. The axle 12 of the first cog wheel 10 is united with cog wheel 10 by means of a key joint and extends through a through-hole 90 for the axle in the base part 71. The through-hole 90 terminates in and is coaxial with the bearing housing 13. The axle 12 further is journalled in a blind boring 92 in the cover 72, concentrical with the through-hole 90 for the axle. Sliding bearings for axle 12 are designated 91. The second cog wheel 11 has an axle journal 89 which is journalled in sliding bearings 93 in blind borings 95 and 96 in the base part 71 and in the cover 72, respectively.

The through-hole 90 for the axle as well as the journal borings 92, 95 and 96 are made by boring normal to the flat surfaces 75 and 76.

The inlet hydraulic conduit 5, see also FIGS. 1 and 2, extends with its first section 5A slightly inclined upwards in the connection portion 79 of base part 71. The inclination angle against the parting plane 75 and hence against the outer surface of the framing 53 in the region of the opening 81 affords the hydraulic conduits 56, 57 a suitable direction, so that they do not interfere with the handle 54, FIG. 3. After the slightly inclined first section 5A there follows the second, steaper section 5B, which terminates in the parting plane 75 opposite the inlet chamber 3 of the motor chamber 2, which inlet chamber is bored in the cover 72. In the same manner, the hydraulic outlet conduit 7 extends with its sections 7A and 7B in parallel with the sections 5A and 5B of conduit 5. The conduit sections 5B and 7B are bored into the base part 71 at an angle against surface 75 all the way to the first sections 5A and 7A, respectively, which are bored at a smaller angle into the connection portion 79. The section 5A has an extension, as has previously been explained with reference to FIG. 1, defining a blind boring/plunge chamber 35 in base portion 71.

The by-pass conduit 15 as well as all conduits and passages for the pilot valve 30 are manufactured through working from the parting plane 74, i.e. against the flat surfaces 75 and 76. This is beneficial from a manufacturing point of view at the same time as the number of possible leaking points is minimized.

A first connection in the form of a boring 100 normal to surface 75 extends between the parting plane 74/surface 75 and the first section 5A of inlet conduit 5. In parallel with this first connection 100 a second connection in the form of a boring 101 extends between the parting plane 74 and the first section 7A of outlet conduit 7 normal to surface 75. Approximately half away between the parting plane 74 and the centres of sections 5A, 7A the cross link 18 extends between the first boring and the second boring 101 in parallel with the parting plane 74/surface 75. The cross link 18 is made by milling walls of borings 100, 101 by means of a milling cutter placed in the boring 100 and 101, respectively. An annular groove which is milled in the wall in the connection/boring 100 is designated 99. In the second boring 101 a recess is milled in that part of the wall which is adjacent to the fist boring 100 to such a depth that the cross link 18 is established between the two connections/borings 100, 101.

That part of the first connection/boring 100 which extends between the inlet conduit section 5A and the cross connection 18 defines the above mentioned first by-pass portion 16. That part of the first boring 100, which extends between the cross link or connection 18 and the parting plane 74, together with an extension 104 of the first boring in the cover 72 form the above mentioned valve chamber 19. That portion of the first connection/boring 101, which extends between the outlet conduit portion 7A and the cross link 18, defines the above mentioned second by-pass portion 17. That portion of the second connection/boring 101, which extends between the cross link 18 and the parting plane 74, is designated 106 and is denominated upper outlet portion. During operation of the motor it has a blind end wall that at stoppage of the motor has a communication function which shall be more closely explained in the following.

Figure 6:
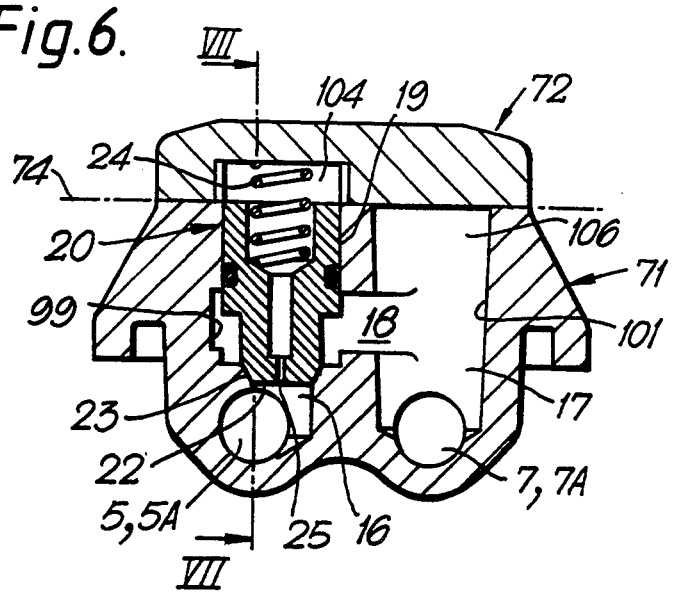
FIG. 6 is a section along the line VI—VI in FIG. 5.

The main valve 20 has a piston 21, which can be displaced in the cylindrical valve chamber 19 between a foremost sealing position, FIG. 6, in which the valve plus 22 abuts the valve seat in the first by-pass portion 16, and a rear position, in which the piston 21 abuts the end wall in the boring 104 in the cover 72. In the latter position the cross link 18 is opened, so that the hydraulic liquid can flow from the conduit portion 5A via the first by-pass portion 16, the cross link 18 and the second by-pass portion 17 to the outlet conduit.

The pilot valve 30 is located entirely inside the motor body 70. As for the main valve 20, the parting plane 74 has been used also for boring those chambers and passages which are required for the pilot valve. Thus a through-boring 110 extends through the base part 71 normal to the parting plane 74. This through-boring 110 is bored in a direction against the surface 75. Further, there is used a blind boring 111 for the pilot valve 30, extending upwards a distance in the cover 72 from the parting plane 74 coaxial with boring 110. A cylindrical tubular sleeve 112 has in its upper part a portion 113 having a slightly larger diameter than the main part of the sleeve. This upper flange portion 113 is located in the boring 111 in the cover 72, which secures the sleeve 112 in its position. The main part of the sleeve extends along the major part of the boring 110, which at its bottom has a constriction 114. The turning slide 33 is rotably journalled in the sleeve 112 and in its upper part it is secured in the sleeve by means of a spring washer.

The pin 67, by means of which the link 64 is fastened, FIG. 4, projects beyond the constriction 114.

The main part of the turning slide 33 as a matter of fact constitutes part of the actuator of the pilot valve 30. The operative pilot valve 30 is formed of coacting parts of the turning slide 33 and the sleeve 112 in the region of and in regions adjacent to the parting plane 74. Thus, the turning slide 33 in its inner end has a central boring 115, which extends over the parting plane 74 and has a depth indicated by dashed lines in FIG. 5. The slide 33 has a number of small through-holes 116 in the region of the boring 115. At the same levels as these borings 116 in the slide 33 in the region of the boring 115, the sleeve 112 has corresponding through-holes 117, FIG. 8. By turning the slide 33 the holes 116 can be positioned opposite the holes 117, so that the holes 116 and 117 will communicate with each other, FIG. 8. The holes 116 corresponds to the channel 34 in FIGS. 1 and 2.

The connection 31, FIGS. 1 and 2, between the valve chamber 19 and the pilot valve 30 consists of a groove 118 in the flat surface 75 of the motor body 72, i.e. of a groove in connection to the parting plane 74. The groove 118 extends from the boring 100, forming an arc to the boring 110 of pilot valve 30. The groove or channel 118 is getting deeper along its way and has such a large depth where the groove 118 terminates in the side of boring 110 that the groove/channel 118 will communicate with the holes 117 in the sleeve 112. It should also be observed that the boring 104 in the cover 72 has a larger diameter than the boring 100 in the region of the valve chamber 19, so that the valve chamber 19 in all positions of the valve piston 21 will communicate with the groove/channel 118.

The connection 32, FIGS. 1 and 2, from the pilot valve 30 to the outlet conduit 7 is formed by the central boring 115 in the turning slide 33, by the boring 111 in the cover 72 and by a groove 119 which is milled in the cover 72 in connection to the parting plane 74 between boring 111 and said upper outlet portion 106, which constitutes part of said second connection/boring 101 in the base part 71 communicating with the outlet conduit 7. By adjusting the holes 116 to positions opposite the holes 117 there is thus created a connection between valve chamber 19 and outlet conduit 7 via the boring 104, the groove/channel 118, the holes 117, the holes 116, the boring 115 in the turning slide 33, the boring 111 and the milled groove 119 in the cover 72, the upper outlet portion 106 and said second by-pass portion 17. Concerning the conduits 31, 32 and 33, FIGS. 1 and 2, thus not all details correspond to the preferred, practical embodiment according to FIGS. 5–10.

As far as the plunge valve 36 provided in the base part 71 is concerned, reference is made to the description which has been made above with reference to FIGS. 1 and 2.

Figure 7:
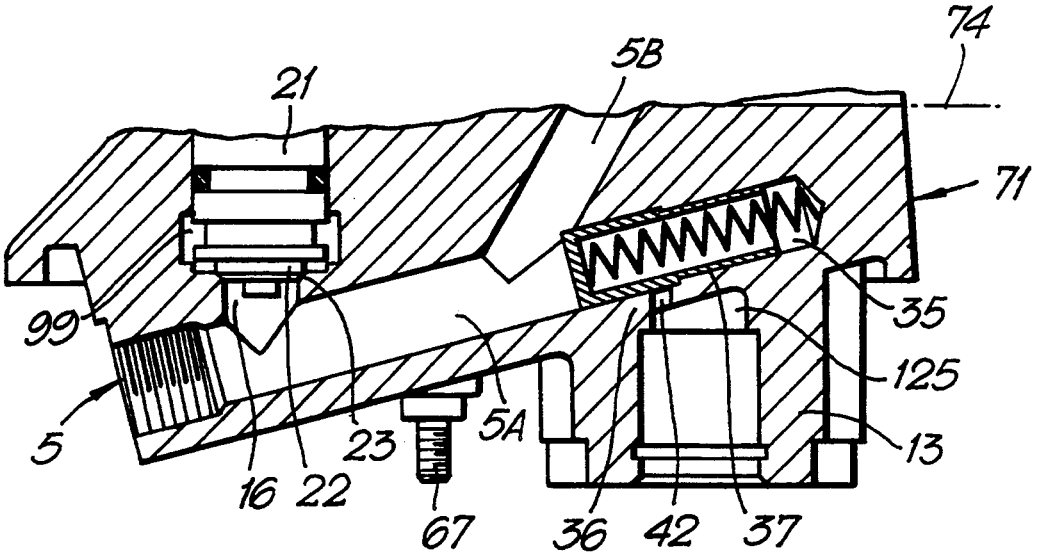
FIG. 7 is a section along the line VII—VII in FIG. 6.

The first drainage conduit 42 extends from the plunge chamber 35 to a bearing housing chamber 35 on the inner side of a ball bearing 126, which in its turn is provided on the inner side of an axial seal 127 in the bearing housing 13. The first drainage conduit 42 is shown in FIG. 7, which shows a section in a plane adjacent to one side of the bearing housing 13. Only a small part of the bearing housing chamber 125 therefore is seen in this view. From the bearing housing chamber 125 a second drainage conduit 43 extends up to a milled recess 130 in the flat surface 75 of the base part 71, i.e. in connection to the parting plane 74. The milled recess 130 connects the terminal of the second drainage conduit 43 with section 7B of the outlet conduit 7, FIG. 9.

Figure 8:
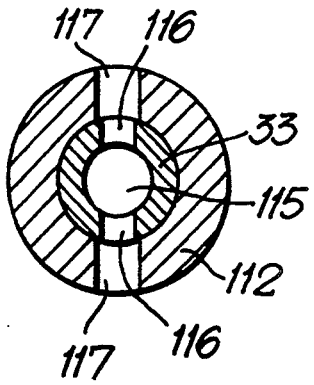
FIG. 8 is a section along the line VIII—VIII in FIG. 5 at a larger scale.
Figure 9:
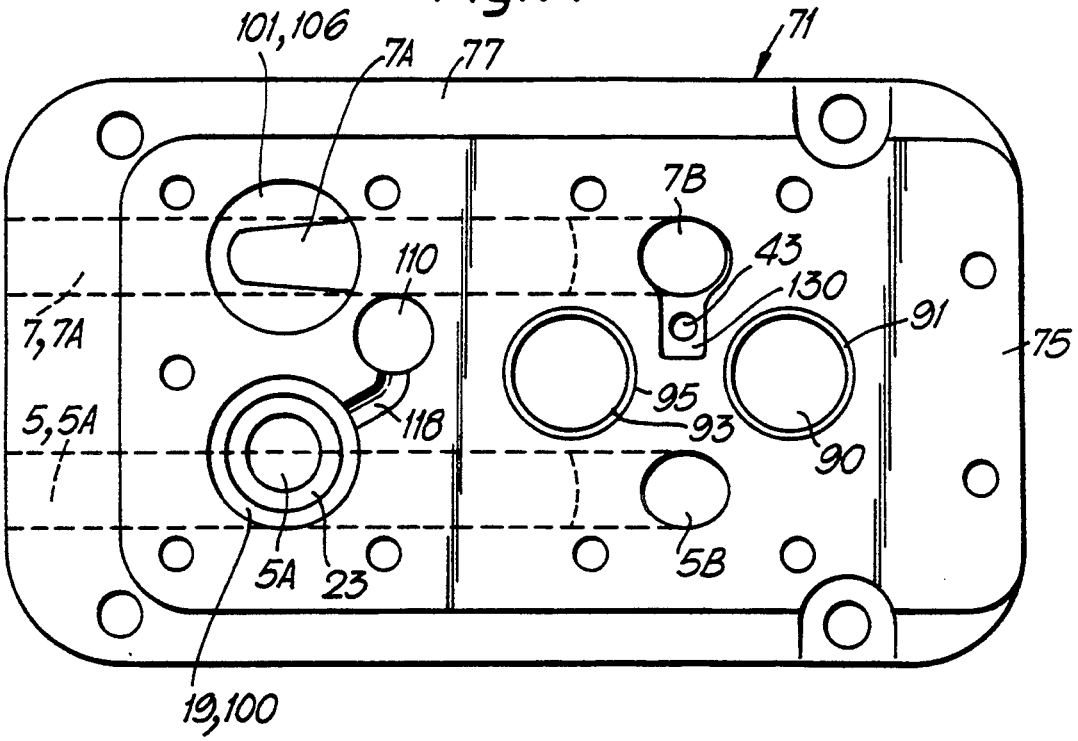
FIG. 9 shows one of the main parts—the base part—of a motor body as viewed in a parting plane along a line IX—IX in FIG. 5.
Figure 10:
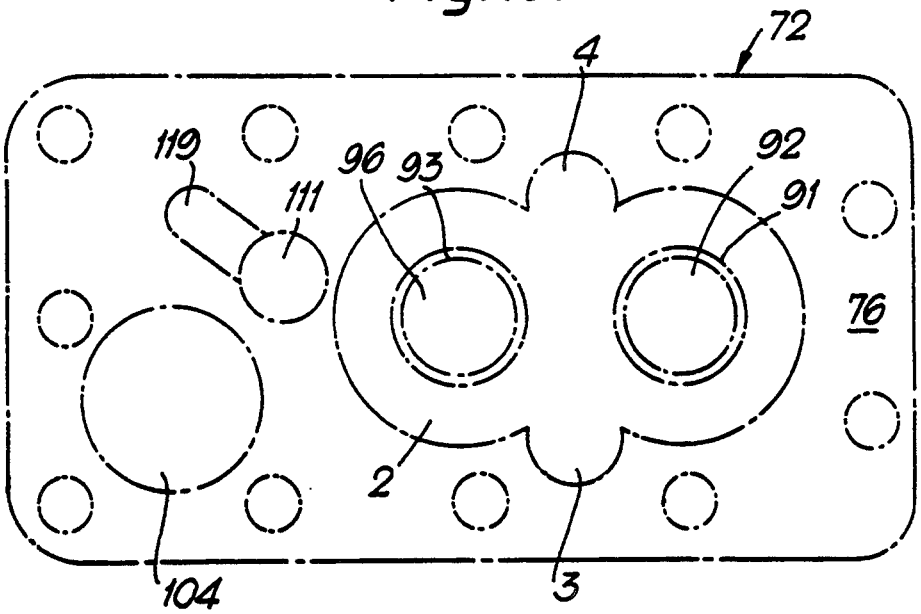
FIG. 10 shows the second main part—the cover—of the motor body as viewed in a parting plane along the line X—X in FIG. 5. This illustration has been turned 180° about its longitudinal central line—which illustrates a view in the same direction as the view along the line IX—IX—in order to facilitate the understanding of the cooperation of the various elements of the cover with the various elements in the base part, FIG. 9.

The mode of operation of the above described hydraulic motor 1, 52 now shall be explained more in detail. When the operator moves the trigger 65, FIG. 4, upwards, the trigger is caught in the upper position in a manner known per se. The turning slide 33 is rotated via the link 64 and the pin 67, so that the holes 116, FIG. 8, are closed. This position corresponds to the position of the turning slide 33, which is shown in FIG. 1, which corresponds to working conditions.

The main valve chamber 19 communicates with the inlet conduit 5 through the opening 25 in the valve plug 22. The pressure on both sides of the main valve 20 at this moment is equal. Because on one hand of the larger cross section area of the rear part of the valve body and on the other hand of the spring 24 the valve plug 22 is pressed against the valve seat 23. Herethrough the cross link 18 is disconnected, so that the by-pass conduit 15 is completely closed. At this moment there i s full pressure along the whole length of the inlet conduit 5, i.e. also in the sections 5A and 5B, which keeps the plunge 37 in the plunge valve 36 pressed into the plunge chamber 35, so that the hydraulic medium can pass freely from section 5A to section 5B and into the inlet chamber 3. The hydraulic medium drives the cog wheels 10, 11 under pressure by passing in a manner known per se between the cog wheels to the outlet chamber 4 and therefrom via the two portions 7B and 7A of the outlet conduit 7 to the return hydraulic hose 57, FIG. 4. The cog wheel 10 drives the axle 12, which in its turn drives the belt pulley 59 and the driving belt 58.

Hydraulic oil, which passes beyond the plunge 37, either through a possible leakage and/or through the opening 40, is guided to the bearing housing chamber 125 through the first drainage conduit 42. In the chamber 125 also such oil is collected which may leak by passing the axle sealing 91 in the base part 71. From the hydraulic chamber 125 collected hydraulic oil is fed to the outlet conduit 7, 7B via the second drainage conduit 43, which is in connection with the outlet conduit 7, 7B through the milled recess 130, FIG. 9.

During operation, still with reference to FIG. 1, the rear edge of the foremost plunge section 37A abuts the annular edge 41. In this position the plunge 37 effectively closes the evacuation conduit 42. The plunge chamber 35, however, communicates through the hole 40 with the inlet conduit 5, so that there will be equal pressure on the front and rear sides of the plunge during operation, FIG. 1. It should also be observed that the plunge 37 has the same inner diameter along its entire length corresponding to the inner diameter of the rear part 37A of the plunge. The outer diameter in the region of the front part 37A of the plunge is also substantially larger than its inner diameter. Under the prevailing equilibrium pressure the hydraulic power which acts on the plunge on the front side will, because of the said area difference, be substantially larger than the power which acts on the rear side. The power difference is substantially larger than the power of the spring 38, so that the plunge 37 during operation will be safely pressed into the bottom position which is defined by the annular edge 41 against which the foremost plunge portion 37A abuts with its rear edge. Herein it is made sure that the passage between the two sections 5A and 5B of the inlet conduit is completely free and also that no leakage can take place through the evacuation conduit 42, which is completely closed by the plunge.

When the hydraulic motor 52 shall be stopped, the trigger 65 is released, so that the trigger by spring action is withdrawn to its lower resting position by turning about a pivot 69. The trigger 65 acts upon the moment link 66 via the link 64, so that the moment link 66 via the pin 67 turns the turning slide 110 about its centre of rotation, so that the holes 116 in the turning slide is positioned opposite the holes 117 in the sleeve 112. This corresponds to the position in FIG. 2, where the channel 33 connects the conduit 31 with the conduit 32.

Hydraulic oil can now, FIGS. 3–10, flow from the valve chamber 19 to the outlet conduit 7 via the recess 104 in the cover 72, the groove/channel 118 in the base part 71 in connection to the parting plane 74, through the holes 117 and 166 to the central boring 115 in the turning slide 110, through the boring 115 to the boring 111 in the cover 72, therefrom through the milled recess 119 in the cover 72 in connection to the parting plane 74 to the upper outlet portion 106 of the boring 101, and through the boring 101 to the outlet conduit 7. By establishing this passage, the pressure drops in the valve chamber 19. The valve piston 21 in the main valve 20 now is pressed upwards in the valve chamber 19 under the influence by the hydraulic pressure, which acts upon the valve plug 22, so that the cross link 18 is freed, wherein the by-pass conduit 15 is opened.

The hydraulic medium now will flow freely through the by-pass conduit 15, i.e. through the first by-pass portion 16 in the lower part of the boring 100 in the base part 71, through the cross connection 18 and the second by-pass portion 17 in the lower part of the second boring 101 to the outlet conduit 7. Herein the pressure in the inlet conduit 5 will drop, which has an influence upon the plunge valve 36. Thus, as the pressure in both the portions 5A and 5B of the inlet conduit 5 drops, the pressure in the plunge chamber 35 will exceed that in the portions 5A, 5B of the inlet conduit. The pressure difference and the return spring 38 drive the plunge out of the plunge chamber 35 so far that the plunge passes beyond the edge 41, so that the evacuation conduit 42 is opened, and so that the front section 37A of the plunge will extend into the first section 5A of the inlet conduit, FIG. 2, at least so far that the passage between the sections 5A and 5B will be completely closed. The hydraulic pressure in the plunge chamber 35 drops by the fact that the plunge chamber communicates with the evacuation conduit 42. Therefore, there will act upon the plunge 37 a resulting hydraulic power which tends to move the plunge 37 into the plunge chamber 35, but this power is compensated by the return spring 38, which is dimensioned for this purpose, so that the plunge during stoppage of operation, when hydraulic medium flows through the by-pass conduit 15, is maintained in the position shown in FIG. 2. Because of the pressure difference on the front and rear side of the plunge, which is small per se, a negligible flow of hydraulic medium will flow through the opening 40 during operation and be evacuated through the evacuation conduit 42, the bearing housing 13, and the conduit 43 to the return conduit 7.

Possibly the plunge in the closing position may be moved more forwards in the first portion 5A of the inlet conduit. The plunge is designated 37' in this foremost position, which is indicated by ghost lines. It is true that the first section 5A in this case communicates with the second section 5B through the hole 40, but the flow is negligible and is moreover evacuated through the evacuation conduit 42. By the fact that the plunge 37 can have a closing action over a comparatively large range, the plunge valve will function in the intended manner within a range which is variable to a corresponding degree as far as the hydraulic pressure in the inlet conduit 5 is concerned and allows moreover large tolerances concerning the characteristics of the plunge spring 38.

When the motor shall be started, the operator closes the pilot valve 30 by means of the trigger 64. The hydraulic pressure in the main valve chamber 19 is increased and is equalled through the communication between the inlet portion 16 of the by-pass conduit and the valve chamber 19 very quickly to equilibrium between the portion 16 and the valve chamber 19. The pressure in the cross link 18, however, is somewhat lower than in the first by-pass portion 16. The hydraulic power, which acts upon the rear side of the valve body, therefore will be somewhat larger than that one which acts on the front side which drives the valve plug downwards against the valve seat. Moreover, the return spring 24 coacts in this closing movement which brings the valve plug 22 to sealing abutment against the seat 23.

When the main valve 22 has been closed, the pressure in the first section 5A of the inlet conduit is increased almost momentaneously to full pressure, which with full power acts upon the plunge 37. The plunge chamber 35 at this moment is filled with hydraulic medium, which is evacuated according to the following. During a first moment, until the rear edge of the rear section 37B of the plunge has passed the annular edge 41, the hydraulic chamber 35 communicates with the evacuation conduit 42, so that hydraulic medium from the hydraulic chamber 35 freely can be evacuated through conduit 42. During the subsequent moment of the movement of the plunge, hydraulic medium existing inside the plunge 37 is pressed out through the opening 40, while the hydraulic medium which exists in the annular gap between the rear portion 37B of the plunge and the plunge chamber wall in its outer broader portion 35B is pressed out through the evacuation conduit 42, so that the plunge can reach its bottom position. In this position the rear edge of the foremost, broader plunge portion 37A is pressed against the annular edge 41, which defines the bottom of the foremost plunge chamber portion 35A. Therein the completely open position with free passage between the two portions 5A and 5B of the inlet conduit has been reachieved, which position was described at the beginning.

We claim:

1. A hydraulic motor having a motor body, said motor body containing a hydraulic medium under pressure, said motor body comprising a first and a second part, said first and second parts being joined to each other at a parting plane, a motor chamber comprising borings which extend from the parting plane into at least one of said first and second parts, said motor chamber having an inlet side and an outlet side, a driving mechanism provided in the motor chamber in order to rotate an axle under pressure from the hydraulic medium, said axle extending through an axle passage through one of said first and second parts, an inlet hydraulic conduit which extends to the inlet side of the motor chamber, an outlet conduit which extends from the outlet side of the motor chamber, a by-pass conduit which is provided between the inlet and outlet conduits, and in the by-pass conduit a main valve which is provided to close and to open the by-pass conduit for stopping and for starting the hydraulic motor, respectively, said by-pass conduit comprising portions of a first and of a second connection between the parting plane and the inlet conduit, and between the parting plane and the outlet conduit, respectively, and by a cross link between said first and second connections, the main valve being provided in one of said first and second connections, and the main valve being actuated by a pilot valve provided in the motor body, Wherein said pilot valve is provided in a region at one of said first and second parts or in regions of both of said parts in connection to said parting plane between them, and said main valve includes a rear side; further comprising a pilot valve operating mechanism provided in a pilot valve boring extending through one of said first and second parts to at least the parting plane, and a plurality of conduits to and from said pilot valve provided between the by-pass conduit on the rear side of said main valve and the pilot valve, and between the pilot valve and the outlet hydraulic conduit, respectively.

2. A hydraulic motor having a motor body, said motor body containing a hydraulic medium under pressure, said motor body comprising a first and a second part and having an outer side, said first and second parts being united with each other at a parting plane, a motor chamber comprising borings which extend from the parting plane into at least one of said first and second parts, said motor chamber having an inlet side and an outlet side, a driving mechanism provided in the motor chamber in order to rotate an axle under pressure from the hydraulic medium, said axle extending through an axle passage through one of said first and second parts, an inlet hydraulic conduit which extends to the inlet side of the motor chamber, an outlet conduit which extends from the outlet side of the motor chamber, a by-pass conduit which is provided between the inlet and outlet conduits, and in the by-pass conduit a main valve which is provided to close and to open the by-pass conduit for stopping and for starting the hydraulic motor, respectively, and the main valve being actuated by a pilot valve provided in the motor body, wherein said pilot valve is provided in a region at one of said first and second parts or in regions of both of said parts in connection to said parting plane between them, and said main valve includes a rear side; further comprising a pilot valve operating mechanism provided in a pilot valve boring extending through one of said first and second parts to at least the parting plane, and a plurality of conduits to and from said pilot valve provided between the by-pass conduit on the rear side of said main valve and the pilot valve, and between the pilot valve and the outlet hydraulic conduit, respectively.

3. A hydraulic motor according to claim 2, wherein the pilot valve is a turning slide valve and said pilot valve operating mechanism is at least partly formed by an extension of the turning slide valve in the form of a turning spindle which extends through said pilot valve boring such that, on the outer side of the hydraulic motor, it exhibits a connection member for a turning device.

4. A hydraulic motor according to claim 2, wherein said pilot valve is provided in connection to the parting plane, and the plurality of conduits to and from the pilot valve at least partly are formed by a plurality of recesses in said first and second parts in connection to the parting plane, wherein a first recess in one of said first and second parts extends from at least one of a first connection between the parting plane and the inlet conduit, and from an extension of said first connection in the second, opposite part to said pilot valve boring, and a second recess, which is provided in the other of said first and second parts, extends from said pilot valve boring in one of said first and second parts to a second connection between the parting plane and outlet conduit.

5. A hydraulic motor according to claim 1, wherein said cross link is provided at a distance from the parting plane, said cross link being part of the by-pass conduit.

6. A hydraulic motor according to claim 5, wherein said cross link is formed by one or more grooves milled in the wall of at least one of said first and second connections.

7. A hydraulic motor according to claim 5, wherein said main valve comprises a piston valve having a valve seat in said first connection adjacent to the inlet conduit, and including a valve piston, which, when assembled with a valve plug, abuts the valve seat, closes the passage between the inlet conduit and the cross link and closes the whole by-pass conduit, and which, when it is brought to its opposite end position, opens the passage between said first and second connections via the cross link.

8. A hydraulic motor according to claim 7, further comprising a coaxial boring in the second part, said coaxial boring being coaxial with said first connection, said coaxial boring having a larger diameter than said first connection, said coaxial boring communicating with said first recess and communicating, when the valve plug of the main valve abuts the seat, with the pilot valve via a channel having a very small diameter in the valve plug.

9. A hydraulic motor according to claim 1, wherein the motor chamber is provided in said second part, said driving mechanism comprises a pair of cog wheels, an inlet chamber and an outlet chamber, in connection with said motor chamber, comprises borings extending into said second part from the parting plane, said inlet and outlet conduits have inner ends, and said inlet and outlet conduits, which extend through the first part, terminate with their inner ends in the parting plane opposite said inlet and outlet chambers.

10. A hydraulic motor according to claim 3, wherein said pilot valve is provided in connection to the parting plane, and the plurality of conduits to and from the pilot valve at least partly are formed by a plurality of recesses in said first and second parts in connection to the parting plane, wherein a first recess in one of said first and second parts extends from at least one of a first connection between the parting plane and the inlet conduit, and from an extension of said first connection in the second, opposite part to said pilot valve boring, and a second recess, which is provided in the other of said first and second parts, extends from said pilot valve boring in one of said first and second parts to a second connection between the parting plane and outlet conduit.

11. A hydraulic motor according to claim 2, wherein the motor chamber is provided in said second part, said driving mechanism comprises a pair of cog wheels, an inlet chamber and an outlet chamber, in connection with said motor chamber, comprises borings extending into said second part from the parting plane, said inlet and outlet conduits have inner ends, and said inlet and outlet conduits, which extend through the first part, terminate with their inner ends in the parting plane opposite said inlet and outlet chambers.

12. A hydraulic motor according to claim 3, wherein the motor chamber is provided in said second part, said driving mechanism comprises a pair of cog wheels, an inlet chamber and an outlet chamber, in connection with said motor chamber, comprises borings extending into said second part from the parting plane, said inlet and outlet conduits have inner ends, and said inlet and outlet conduits, which extend through the first part, terminate with their inner ends in the parting plane opposite said inlet and outlet chambers.

13. A hydraulic motor according to claim 4, wherein the motor chamber is provided in said second part, said driving mechanism comprises a pair of cog wheels, an inlet chamber and an outlet chamber, in connection with said motor chamber, comprises borings extending into said second part from the parting plane, said inlet and outlet conduits have inner ends, and said inlet and outlet conduits, which extend through the first part, terminate with their inner ends in the parting plane opposite said inlet and outlet chambers.

14. A hydraulic motor according to claim 5, wherein the motor chamber is provided in said second part, said driving mechanism comprises a pair of cog wheels, an inlet chamber and an outlet chamber, in connection with said motor chamber, comprises borings extending into said second part from the parting plane, said inlet and outlet conduits have inner ends, and said inlet and outlet conduits, which extend through the first part, terminate with their inner ends in the parting plane opposite said inlet and outlet chambers.

15. A hydraulic motor according to claim 6, wherein the motor chamber is provided in said second part, said driving mechanism comprises a pair of cog wheels, an inlet chamber and an outlet chamber, in connection with said motor chamber, comprises borings extending into said second part from the parting plane, said inlet and outlet conduits have inner ends, and said inlet and outlet conduits, which extend through the first part, terminate with their inner ends in the parting plane opposite said inlet and outlet chambers.

16. A hydraulic motor according to claim 7, wherein the motor chamber is provided in said second part, said driving mechanism comprises a pair of cog wheels, an inlet chamber and an outlet chamber, in connection with said motor chamber, comprises borings extending into said second part from the parting plane, said inlet and outlet conduits have inner ends, and said inlet and outlet conduits, which extend through the first part, terminate with their inner ends in the parting plane opposite said inlet and outlet chambers.

17. A hydraulic motor according to claim 8, wherein the motor chamber is provided in said second part, said driving mechanism comprises a pair of cog wheels, an inlet chamber and an outlet chamber, in connection with said motor chamber, comprises borings extending into said second part from the parting plane, said inlet and outlet conduits have inner ends, and said inlet and outlet conduits, which extend through the first part, terminate with their inner ends in the parting plane opposite said inlet and outlet chambers.

* * * * *